US010580561B2

(12) United States Patent
Hozoji

(10) Patent No.: US 10,580,561 B2
(45) Date of Patent: Mar. 3, 2020

(54) TRANSFORMER AND POWER CONVERTER

(71) Applicant: HITACHI, LTD., Tokyo (JP)

(72) Inventor: Hiroshi Hozoji, Tokyo (JP)

(73) Assignee: HITACHI, LTD., Tokyo (JP)

( * ) Notice: Subject to any disclaimer, the term of this patent is extended or adjusted under 35 U.S.C. 154(b) by 176 days.

(21) Appl. No.: 15/548,629

(22) PCT Filed: Feb. 5, 2016

(86) PCT No.: PCT/JP2016/053439

§ 371 (c)(1),
(2) Date: Aug. 3, 2017

(87) PCT Pub. No.: WO2016/136421

PCT Pub. Date: Sep. 1, 2016

(65) Prior Publication Data

US 2018/0005748 A1 Jan. 4, 2018

(30) Foreign Application Priority Data

Feb. 26, 2015 (JP) ..... 2015-036987

(51) Int. Cl.
*H01F 27/28* (2006.01)
*H01F 27/02* (2006.01)
(Continued)

(52) U.S. Cl.
CPC ..... *H01F 27/025* (2013.01); *H01F 27/06* (2013.01); *H01F 27/085* (2013.01); *H01F 27/20* (2013.01);
(Continued)

(58) Field of Classification Search
USPC ..... 336/229
See application file for complete search history.

(56) References Cited

U.S. PATENT DOCUMENTS 5,768,113 A 6/1998 Safraoui
8,035,833 B2 * 10/2011 Kim ..... H04N 1/0083 336/182
(Continued)

FOREIGN PATENT DOCUMENTS

JP 60-111016 U 7/1985
JP 61-188884 A 8/1986
(Continued)

OTHER PUBLICATIONS

International Search Report, PCT/JP2016/053439, dated Apr. 5, 2016, 3 pgs.

*Primary Examiner* — Ronald Hinson
(74) *Attorney, Agent, or Firm* — Volpe and Koenig, P.C.

(57) ABSTRACT

An object is to improve a core and heat radiation properties from the coil, and to reduce the size of a transformer. In order to attain the object described above, a transformer includes a bobbin wound around with a coil, a columnar core center portion in which the bobbin is mounted, and a plurality of core leg portions joining both ends of the core center portion on the outside of the coil. The size of the core leg portion is larger than the size of the other core leg portions, and the core leg portion includes a flat outer circumferential surface approximately parallel to a surface which is tangent to an outer circumferential side surface of the coil. The transformer is disposed in a housing such that the outer circumferential surface of the core leg portion is tangent to a floor surface of the housing.

10 Claims, 7 Drawing Sheets

(51) Int. Cl.

| | |
|---|---|
| ***H01F 27/08*** | (2006.01) |
| ***H01F 27/06*** | (2006.01) |
| ***H01F 27/22*** | (2006.01) |
| ***H01F 27/29*** | (2006.01) |
| ***H01F 27/24*** | (2006.01) |
| ***H01F 27/20*** | (2006.01) |

(52) U.S. Cl.
CPC ..... *H01F 27/22* (2013.01); *H01F 27/24* (2013.01); *H01F 27/2823* (2013.01); *H01F 27/29* (2013.01)

(56) References Cited

U.S. PATENT DOCUMENTS

| | | | | |
|---|---|---|---|---|
| 10,068,696 | B2 * | 9/2018 | Yan | H01F 27/2876 |
| 2005/0046534 | A1 * | 3/2005 | Gilmartin | H01F 17/043 336/83 |
| 2005/0247706 | A1 * | 11/2005 | Park | H01F 27/12 219/716 |
| 2013/0043969 | A1 * | 2/2013 | Ota | H01F 3/10 336/229 |
| 2013/0141201 | A1 * | 6/2013 | Chou | H01F 3/10 336/55 |
| 2013/0293330 | A1 | 11/2013 | Wu et al. | |
| 2014/0140111 | A1 * | 5/2014 | Inaba | H01F 37/00 363/37 |

FOREIGN PATENT DOCUMENTS

| | | | |
|---|---|---|---|
| JP | 64-29797 | U | 2/1989 |
| JP | 4-18418 | U | 2/1992 |
| JP | 2001-237122 | A | 8/2001 |
| JP | 2003-324017 | A | 11/2003 |
| JP | 2007-194356 | A | 8/2007 |
| JP | 2008-235529 | A | 10/2008 |
| JP | 2012-156351 | A | 8/2012 |
| JP | 2013-236051 | A | 11/2013 |
| JP | 2014-179516 | A | 9/2014 |

* cited by examiner

TRANSFORMER AND POWER CONVERTER

TECHNICAL FIELD

The present invention relates to a transformer, and a power converter including the transformer.

BACKGROUND ART

A transformer having a structure in which a conductive wire is wound around a core (also referred to as a magnetic core, an iron core, and the like) is frequently used in a power converter of a voltage, a current, or the like. In order to convert a large power by using the transformer, a large core and a thick conductive wire are required, and thus, in order to reduce the size and the weight of the power converter, first, a reduction in the size of the transformer is strongly required.

In a case where the conductive wire wound around the core is thinned in order to reduce the size and the weight of the transformer, the resistance of the conductive wire increases, the temperature of the core increases due to Joule heat thereof, and the core causes magnetic saturation, and thus, a power conversion function as the transformer is lost. In addition, in the case of simply reducing the size of the core without considering an increase in the temperature, a magnetic flux density in the core increases, and thus, naturally, the magnetic saturation easily occurs. Therefore, in order to reduce the size of the transformer, it is necessary to prevent the core from reaching the magnetic saturation by suppressing an increase in the temperature of the core or a winding portion (the coil).

In PTL 1, an example of a transformer including a protrusion of a center portion, which becomes a middle foot by being wound around with a conductive wire, and a ferrite core formed of four leg portions branching off from the outer circumference of the center portion, is disclosed (refer to FIG. 9 or the like). Then, improvement in the heat radiation properties of the ferrite core is described as an effect of including four leg portions.

CITATION LIST

Patent Literature

PTL 1: Japanese Patent Application Laid-Open No. 2003-324017

SUMMARY OF INVENTION

Technical Problem

In the transformer described in PTL 1, the surface area of the core is increased by increasing the leg portion of the core, and thus, the heat radiation properties of the core are surely improved. In the related art, as described in PTL 1, in the transformer having such a core structure, there are many cases where a central axis of the coil is disposed in a perpendicular direction with respect to an installation surface of the core. In this case, for example, it is difficult for cold air from a fan disposed on a side portion of the core to reach the coil and the middle foot portion where the coil is disposed due to a leg portion on the outside which becomes a hindrance. In particular, it may be said that the cold air rarely reaches the coil or the leg portion on a leeward side.

That is, in the related art, it is known that there is a problem that sufficient heat radiation performance is not capable of being obtained, in particular, from the middle foot portion of the core or the coil. For this reason, in order to prevent the magnetic saturation, it is necessary to increase the size of the core for decreasing the magnetic flux density in the core, and the increase in the size of the core becomes a hindrance to a reduction in the size of the transformer.

Therefore, an object of the present invention is to provide a transformer in which a core and the heat radiation properties from the coil can be improved and the size can be reduced, and a power converter including the transformer.

Solution to Problem

A transformer according to the present invention includes: a coil configured by winding a conductive wire into the shape of a spiral cylinder; a core center portion having a columnar shape in which the coil is mounted; and a plurality of core leg portions joining both ends of the core center portion on the outside of the coil, wherein the transformer is disposed in a storage housing in a state in which a central axis of the core center portion is approximately parallel to a floor surface of the storage housing on which the transformer is mounted.

In addition, a power converter according to the present invention includes: a transformer including a coil configured by winding a conductive wire into the shape of a spiral cylinder, a core center portion having a columnar shape in which the coil is mounted, and a plurality of core leg portions joining both ends of the core center portion on the outside of the coil; a storage housing in which the transformer is mounted on a floor surface; and a fan which is disposed on a side surface portion of the storage housing and blows cold air to the transformer, wherein the transformer is disposed in the storage housing such that a central axis of the core center portion is approximately parallel to the floor surface of the storage housing on which the transformer is mounted and a direction of the central axis of the core center portion is identical to a direction of the cold air blown from the fan.

Advantageous Effects of Invention

According to the present invention, a transformer in which a core and the heat radiation properties from the coil can be improved and the size can be reduced, and a power converter including the transformer are provided.

DESCRIPTION OF EMBODIMENTS

Figure 1:
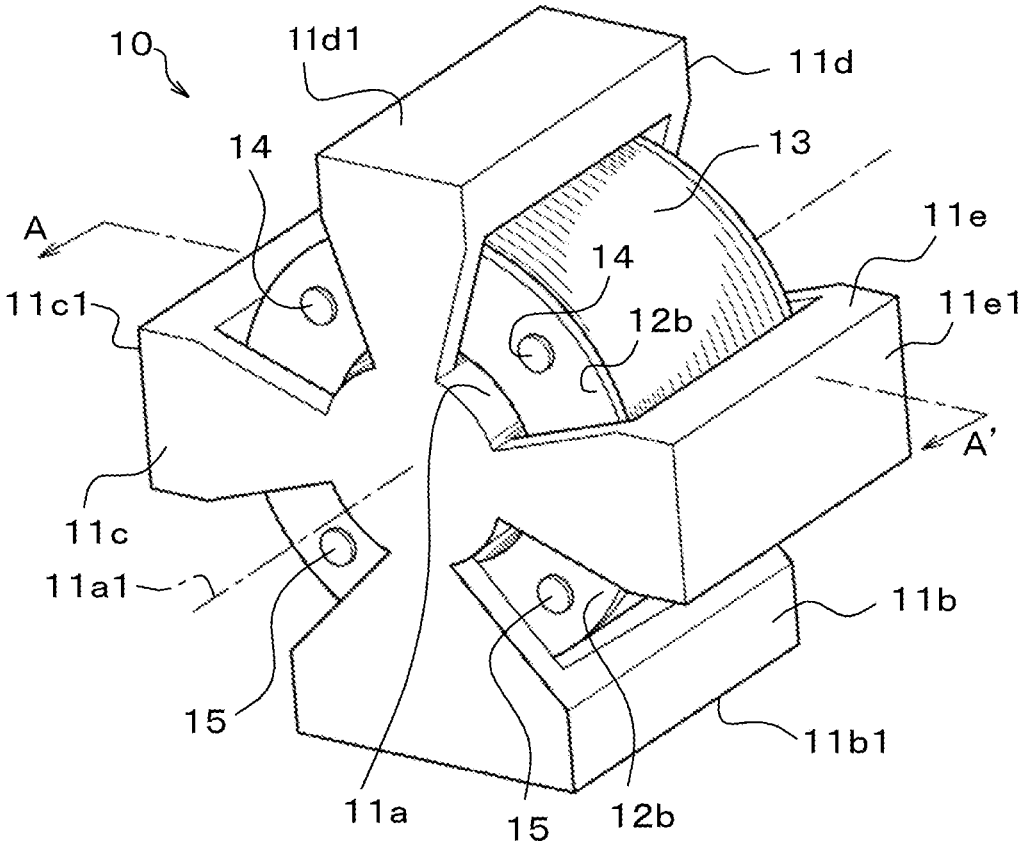
FIG. 1 is a perspective view illustrating an example of a schematic structure of a transformer according to a first embodiment of the present invention.

Hereinafter, embodiments of the present invention will be described in detail with reference to the drawings. Furthermore, in each of the drawings, the same reference numerals are applied to the same constituents, and the repeated description will be omitted.

(First Embodiment)

Figure 2:
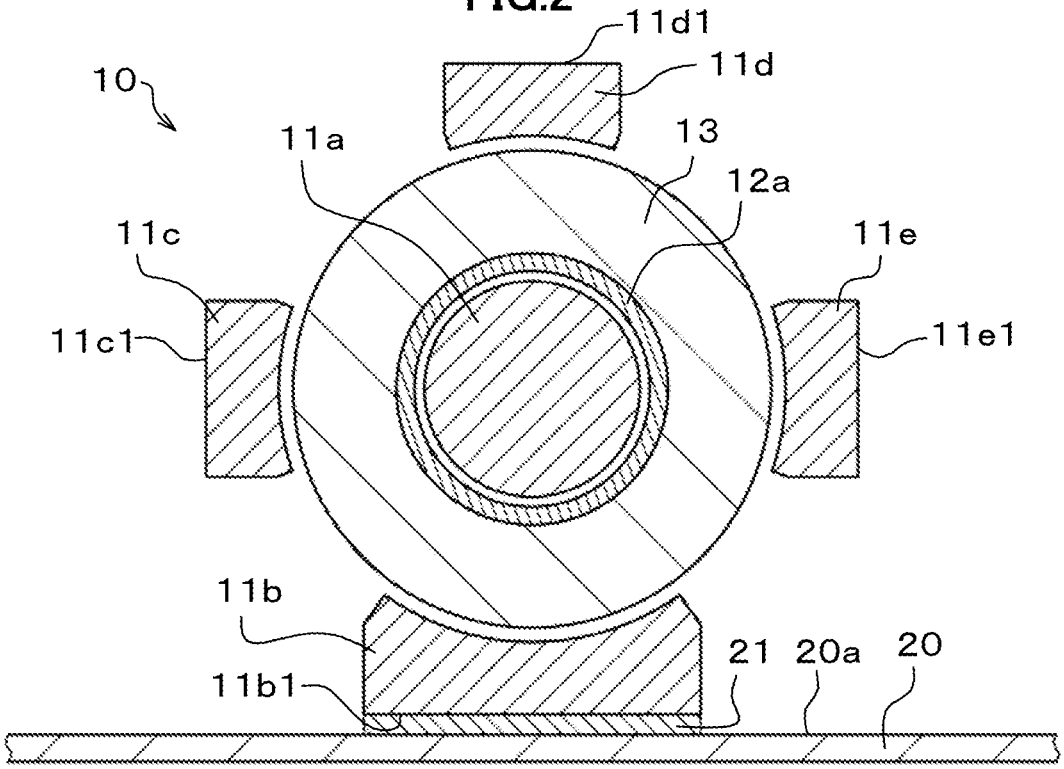
FIG. 2 is a vertical sectional view of the transformer in an A-A' position of FIG. 1.

FIG. 1 is a perspective view illustrating an example of a schematic structure of a transformer 10 according to a first embodiment of the present invention, and FIG. 2 is a vertical sectional view of the transformer 10 in an A-A' position of FIG. 1. As illustrated in FIG. 1 and FIG. 2, the transformer 10 according to this embodiment is configured of a core 11 which is an iron core, a coil 13 which is wound around with a conductive wire into the shape of a spiral cylinder, a bobbin 12 on which the coil 13 is mounted, and a primary coil terminal 14 and a secondary coil terminal 15 for connecting the coil 13 to the external wiring.

Here, the bobbin 12 is formed of a cylindrical portion 12*a* (refer to FIG. 2) which is wound around with the coil 13, and a collar-like flange portion 12*b* (refer to FIG. 1) which is disposed on both ends of the cylindrical portion 12*a* and prevents the conductive wire of the coil 13 from protruding from the cylindrical portion 12*a*.

In addition, the core 11 is configured of a columnar core center portion 11*a* in which the bobbin 12 wound around with the coil 13 is mounted, and four core leg portions 11*b*, 11*c*, 11*d*, and 11*e* joining both ends of the columnar core center portion 11*a* on the outside of the coil 13. Then, here, all of these four core leg portions 11*b*, 11*c*, 11*d*, and 11*e* include flat outer circumferential surfaces 11*b*1, 11*c*1, 11*d*1, and 11*e*1 approximately parallel to a tangential plane (not illustrated) which is tangent to an outer circumferential side surface of the cylindrical coil 13. Furthermore, when a current flows into the coil 13, four core leg portions 11*b*, 11*c*, 11*d*, and 11*e* become a passage (a magnetic path) of a magnetic flux which occurs on the outside of the coil 13.

In addition, in this embodiment, the transformer 10 is disposed on a floor surface 20*a* of a housing 20 in a state where the central axis 11*a*1 of the core center portion 11*a* is approximately horizontally disposed (is approximately parallel to the floor surface 20*a* of the housing 20). Furthermore, herein, the transformer 10 being disposed in the housing 20 in a state where the central axis 11*a*1 of the core center portion 11*a* is approximately horizontally disposed indicates that the transformer 10 (or the core 11) is horizontally disposed.

Here, when the transformer 10 is horizontally disposed on the floor surface 20*a* of the housing 20, the size of the core leg portion 11*b* which support the entire transformer 10 by being tangent to the floor surface 20*a* is greater than the size of the other three core leg portions 11*c*, 11*d*, and 11*e*, and the outer circumferential surface 11*b*1 adheres to the floor surface 20*a*. At this time, it is preferable to use a material not having magnetic properties but having a high thermal conductivity, such as aluminum or copper as the material of the housing 20.

Accordingly, in this embodiment, a contact area between the core 11 and the floor surface 20*a* increases, and thus, it is possible to effectively radiate heat which is generated by the core 11 to the housing 20.

Further, preferably, a high thermal conducting material 21 such as grease having excellent thermal conducting properties is interposed between the outer circumferential surface 11*b*1 of the core leg portion 11*b* and the floor surface 20*a*. Accordingly, it is possible to further improve heat radiation properties from the core leg portion 11*b* to the housing 20.

Furthermore, various materials or various methods can be adopted as the material or a manufacturing method of the core 11, according to an operation frequency or the capacitance of a coil current. For example, in a case where the material is ferrite, a shape illustrated in FIG. 2 can be molded by using a metal mold. In addition, in a case where the material is an amorphous metal foil, the core 11 is formed in a shape where a plurality of metal foils are repeatedly wound and are divided into each of the core center portion 11*a* and the core leg portions 11*b*, 11*c*, 11*d*, and 11*e*, and the core leg portions are combined together, and thus, the core 11 having a desired shape can be formed.

Furthermore, in the above description of the embodiment, the number of core leg portions of the core 11 is set to 4, but is not particularly limited insofar as the number of core leg portions is greater than or equal to 2. In addition, the outer circumferential surfaces 11*c*1, 11*d*1, and 11*e*1 of the core leg portions 11*c*, 11*d*, and 11*e* excluding the core leg portion 11*b* which is tangent to the floor surface 20*a* are flat, but these outer circumferential surfaces 11*c*1, 11*d*1, and 11*e*1 may not be necessarily flat.

Figure 3:
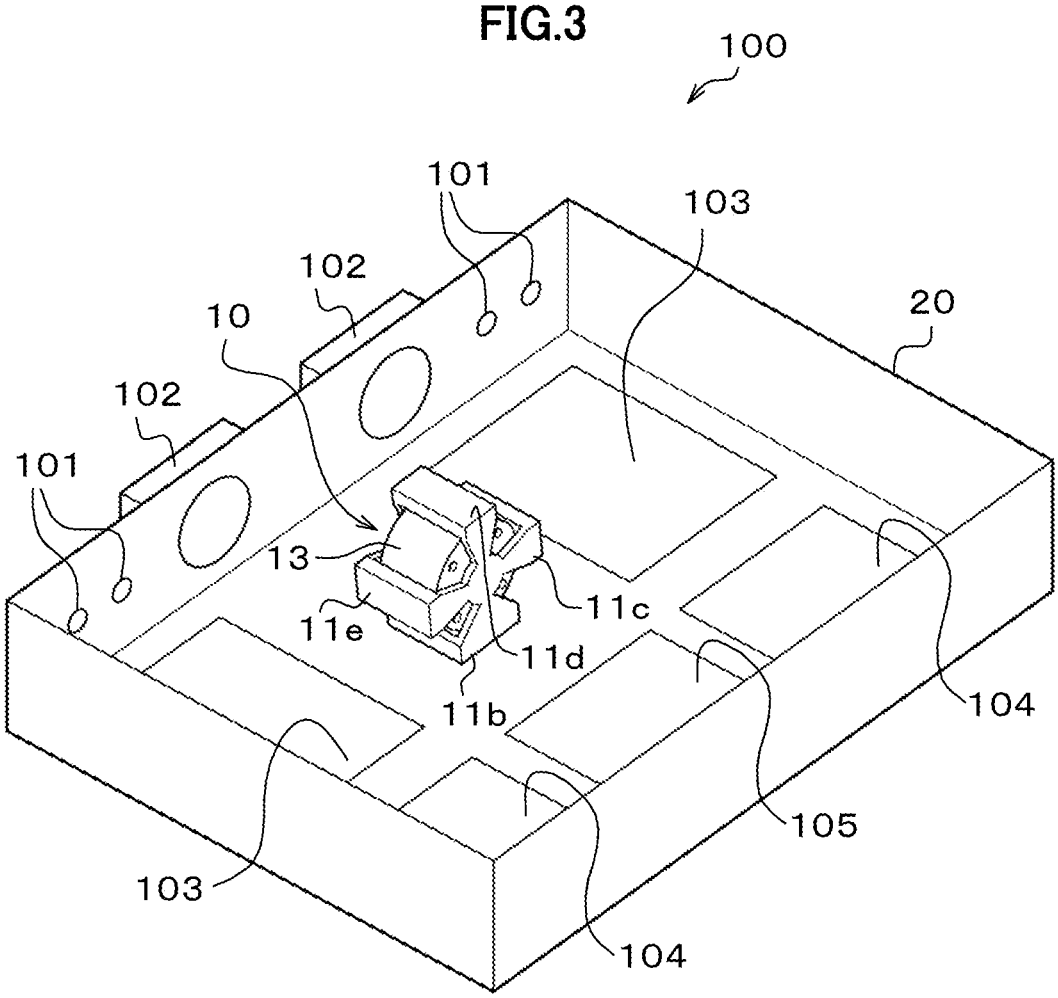
FIG. 3 is a perspective view schematically illustrating an example of arrangement in a housing of a power converter using the transformer according to the first embodiment of the present invention.
Figure 4:
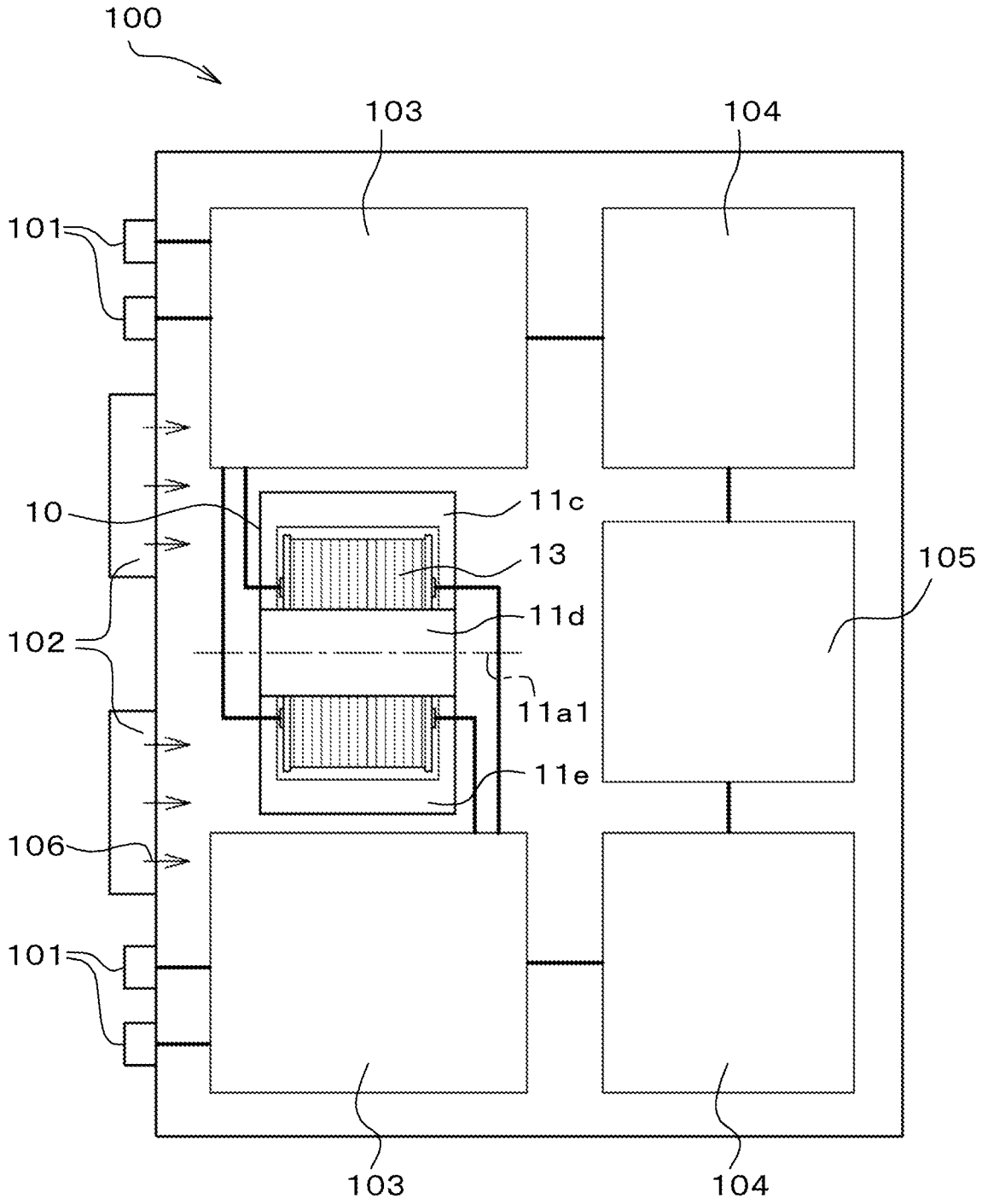
FIG. 4 is a top view of the arrangement in the housing of the power converter illustrated in FIG. 3.

FIG. 3 is a perspective view schematically illustrating an example of arrangement in a housing of a power converter 100 using the transformer 10 according to the first embodiment of the present invention, and FIG. 4 is a top view of the arrangement in the housing of the power converter 100 illustrated in FIG. 3. Here, in these drawings, constituents other than the transformer 10 are illustrated as only a simple block.

As illustrated in FIG. 3 and FIG. 4, in the power converter 100, an input and output terminal 101, a fan 102, and the like are disposed on a side wall portion of the housing 20, and the transformer 10, a power conversion circuit 103, a control circuit 104, a power source circuit 105, and the like are disposed in the housing 20. Here, the power conversion circuit 103 is configured of an AC/DC conversion circuit, a DC/AC conversion circuit, and the like. In addition, the control circuit 104 controls the power conversion circuit 103, and the power source circuit 105 supplies an operation current to the control circuit 104 or the fan 102.

As described above, when the transformer 10 is horizontally disposed on the floor surface 20*a* of the housing 20, as illustrated in FIG. 4, the central axis 11*a*1 of the core center portion 11*a* (refer to FIG. 1) is disposed to be approximately parallel to the direction of cold air 106 blown from the fan 102. In this case, the cold air 106 flows along a side surface of the cylindrical coil 13, and the core leg portions 11*c*, 11*d*, and 11*e*. Accordingly, the coil 13 and the core 11 are more efficiently cooled by the cold air 106 from the fan 102. For this reason, an increase in the temperature of the coil 13 and the core 11 is suppressed, and in particular, the overheating of the core center portion 11*a* is prevented.

Furthermore, the transformer 10 may not be directly disposed on the floor surface 20*a* of the housing 20, and for example, may be disposed on a high thermal conductive circuit substrate in which an insulating resin is applied onto the surface of a base material such as copper or aluminum, and is cured, and a copper circuit is formed on the insulating resin.

Figure 5:
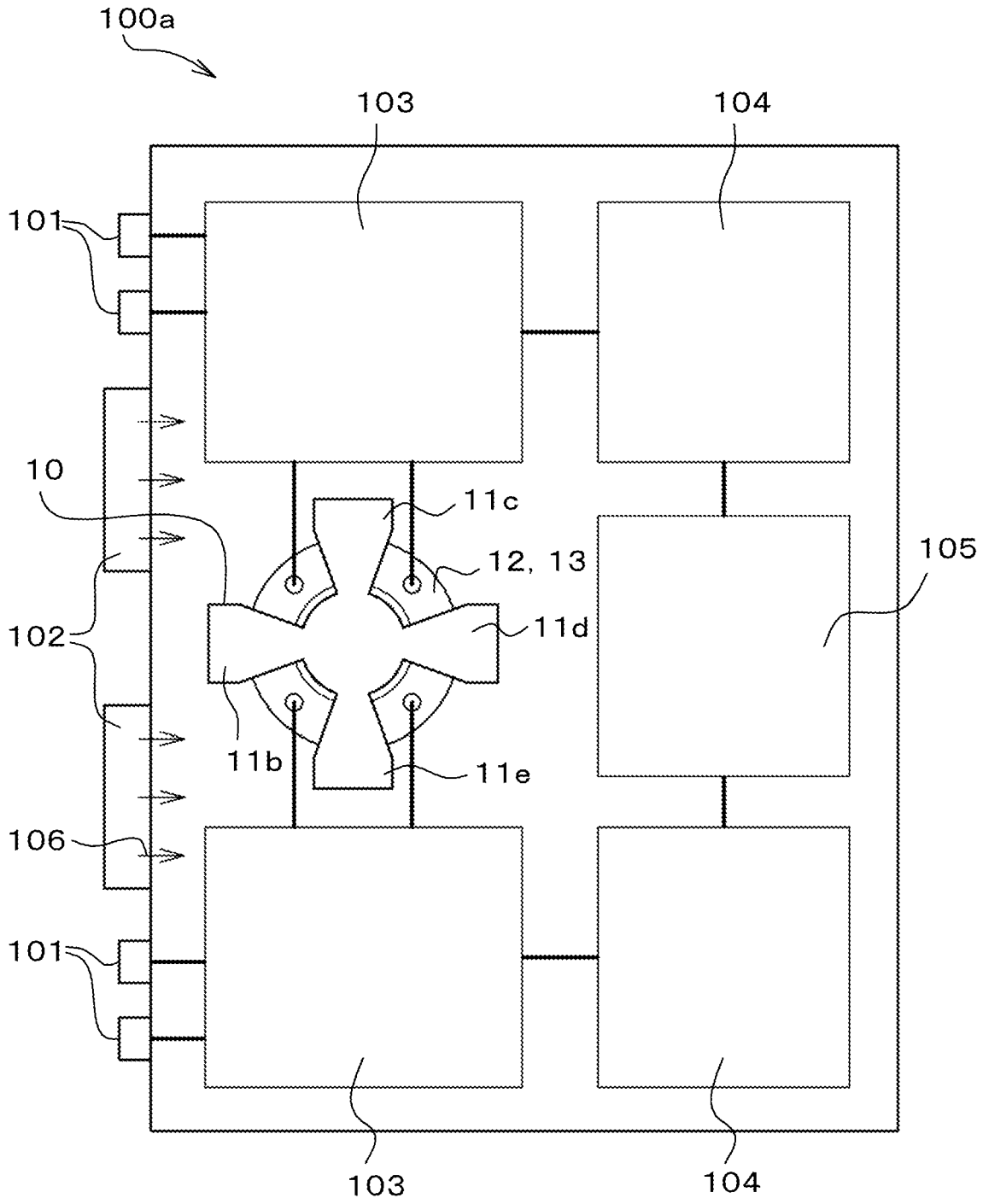
FIG. 5 is a diagram illustrating a top view of arrangement in a housing of a power converter in a case where the transformer is vertically disposed, as a comparative example.

FIG. 5 is a diagram illustrating a top view of arrangement in a housing of a power converter 100*a* in a case where the transformer 10 is vertically disposed, as a comparative example. Here, the transformer 10 being vertically disposed indicates that the transformer 10 is disposed in the housing 20 in a state where the central axis 11*a*1 of the core center portion 11*a* is approximately perpendicularly disposed with respect to the floor surface 20*a* of the housing 20. In a case of the comparative example, the cold air 106 from the fan 102 reaches only the surface of the coil 13 or the surfaces of the core leg portions 11*b*, 11*c*, and 11*e* of the transformer 10 on an upwind side, and rarely reach the surface of the coil 13 or the surface of the core leg portion 11*d* on a leeward side. In addition, the vicinity of the surface of the coil 13 on the upwind side is surrounded by three core leg portions 11*c*, 11*d*, and 11*e*, and thus, the surface of the coil 13 deviates from a flow passage of the cold air 106, and the heat easily remains.

As described above, in a case of the comparative example, in particular, heat radiation from the portion of the coil 13 easily becomes insufficient, and thus, the temperature of the coil 13 increases. Then, in a case where the temperature of the coil 13 increases, a coil resistance thereof increases, and thus, the temperature of the coil 13 increases and the overheating occurs. As a result thereof, the temperature of the core center portion 11*a* in which the coil 13 is mounted also increases and the overheating occurs.

However, the material of the core 11, such as ferrite, in general, has properties that a saturation magnetic flux density decreases in a case where the temperature increases. For this reason, in the comparative example, in particular, it is necessary to increase a column diameter of the columnar core center portion 11*a* in order to prevent the magnetic saturation due to an increase in the temperature of the core center portion 11*a*. However, increasing the column diameter of the core center portion 11*a* indicates an increase in the size of the entire core 11, that is, the transformer 10.

In contrast, in this embodiment, as described above, the transformer 10 is horizontally disposed, and the cold air 106 flows along the side surface of the cylindrical coil 13 or the core leg portions 11*c*, 11*d*, and 11*e*, and thus, an increase in the temperature of not only the coil 13 but also the core center portion 11*a* is suppressed, and the overheating is prevented. That is, in this embodiment, an effect is obtained in which it is possible to decrease the diameter of the columnar core center portion 11*a* and to reduce the size of the transformer 10, compared to the comparative example.

(Second Embodiment)

Figure 6:
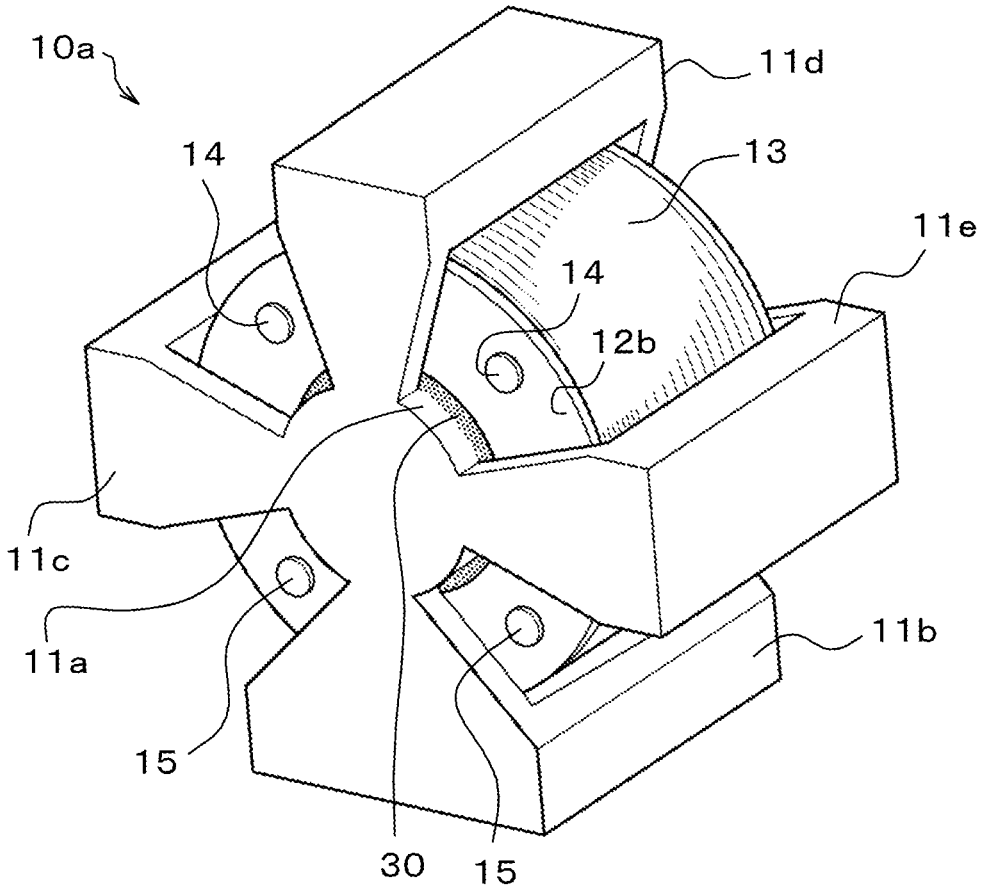
FIG. 6 is a perspective view illustrating an example of a schematic structure of a transformer according to a second embodiment of the present invention.

FIG. 6 is a perspective view illustrating an example of a schematic structure of a transformer 10*a* according to a second embodiment of the present invention. The transformer 10*a* according to the second embodiment has approximately the same structure as that of the transformer 10 (refer to FIG. 1) according to the first embodiment described above, but has following differences. That is, in the transformer 10 according to the first embodiment, a small gap is provided between an inner wall of the cylindrical portion 12*a* of the bobbin 12 and an outer wall of the core center portion 11*a*, and the inner wall of the cylindrical portion 12*a* of the bobbin 12 does not necessarily adhere to the outer wall of the core center portion 11*a*. On the other hand, in the transformer 10*a* according to this embodiment, a high thermal conducting resin 30 is interposed between the inner wall of the cylindrical portion 12*a* of the bobbin 12 and the outer wall of the core center portion 11*a*, and thus, the inner wall of the cylindrical portion 12*a* of the bobbin 12 adheres to the outer wall of the core center portion 11*a* through the high thermal conducting resin 30. Accordingly, in particular, the heat generated on the center side of the coil 13 is easily transmitted to the core center portion 11*a*, and is easily diffused to the outside through four core leg portions 11*b*, 11*c*, 11*d*, and 11*e*.

Considering the above, it is preferable to use a material having high thermal conducting properties and excellent insulating properties as the material of the bobbin 12. For example, a composite material in which ceramic having insulating properties and high thermal conducting properties, such as aluminum nitride, or alumina, is contained in a resin such as polyester, polyethylene, epoxy, and phenol, can be used as the material of the bobbin 12. In addition, a composite material in which a ceramic powder such as aluminum nitride and alumina, a metal powder not having magnetic properties, such as aluminum and copper, carbon, and the like are contained in a resin such as silicone or epoxy, and phenol, can be used as the material of the high thermal conducting resin 30 interposed between the inner wall of the cylindrical portion 12*a* of the bobbin 12 and the outer wall of the core center portion 11*a*.

As described above, according to this embodiment, an increase in the temperature and the overheating of the coil 13 are suppressed, and thus, an increase in the temperature and the overheating of the core center portion 11*a* are also suppressed. Accordingly, in this embodiment, it is possible to further reduce the diameter of the columnar core center portion 11*a*, and thus, to further reduce the size of the transformer 10, compared to that of the first embodiment.

(Third Embodiment)

Figure 7:
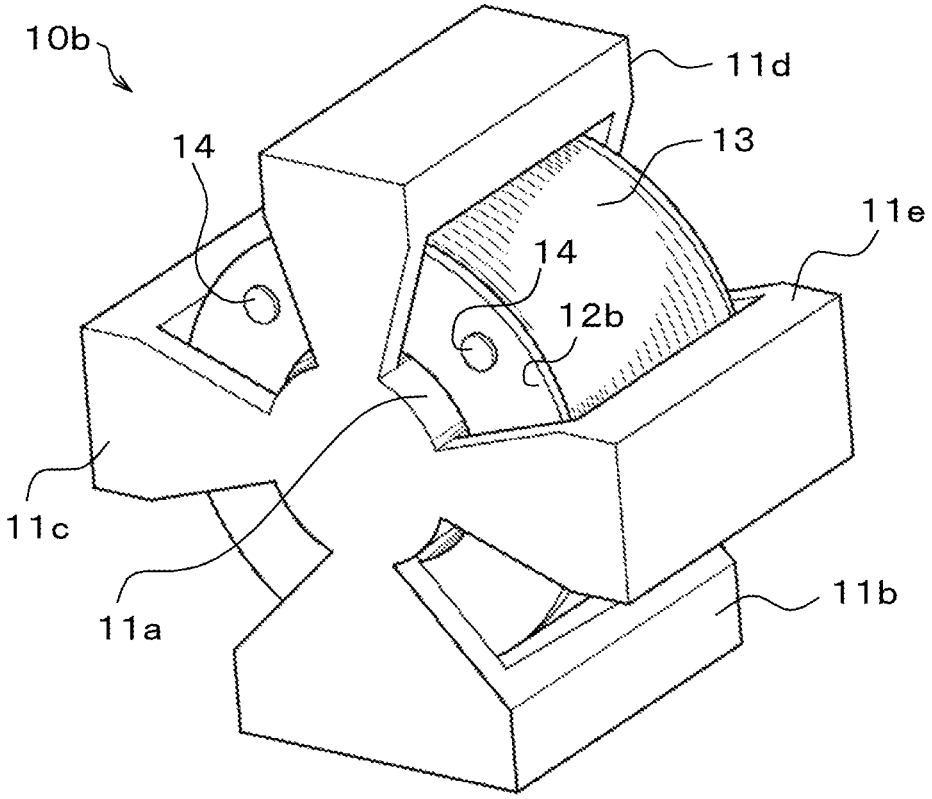
FIG. 7 is a perspective view illustrating an example of a schematic structure of a transformer according to a third embodiment of the present invention.
Figure 8:
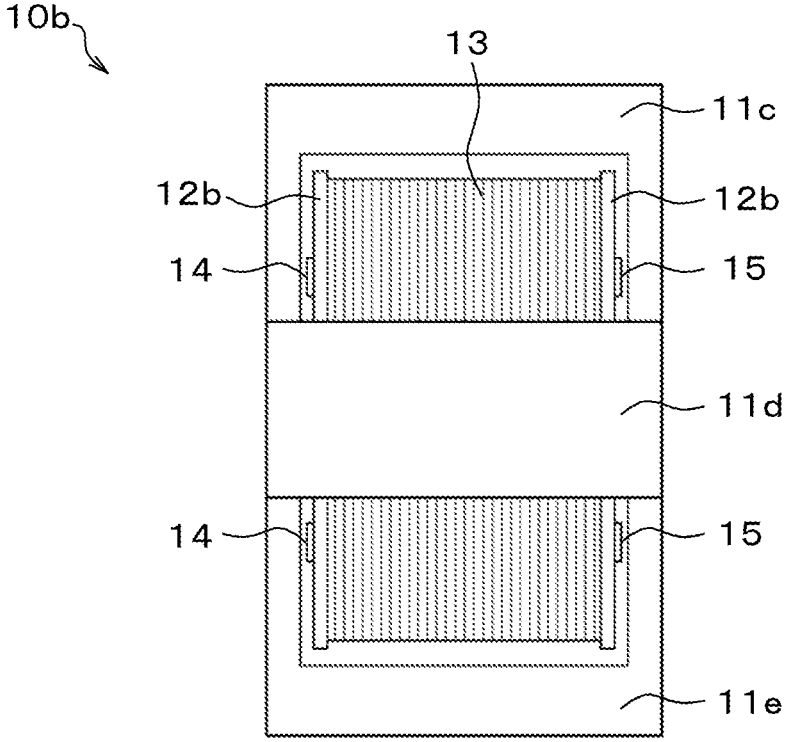
FIG. 8 is a top view of the transformer illustrated in FIG. 7.

FIG. 7 is a perspective view illustrating an example of a schematic structure of a transformer 10*b* according to a third embodiment of the present invention, and FIG. 8 is a top view of the transformer 10*b* illustrated in FIG. 7. The transformer 10*b* according to the third embodiment has approximately the same structure as that of the transformer 10 (refer to FIG. 1) according to the first embodiment described above, but has following differences. That is, in the transformer 10 according to the first embodiment, the primary coil terminal 14 and the secondary coil terminal 15 which are taken out from the coil 13 are disposed in the same flange portion 12*b* of the bobbin 12 (refer to FIG. 1). On the other hand, in the transformer 10*b* according to this embodiment, the primary coil terminal 14 and the secondary coil terminal 15 are disposed in flange portions 12*b* on end portions of the bobbin 12, which are opposite to each other (refer to FIG. 7 and FIG. 8).

Figure 9:
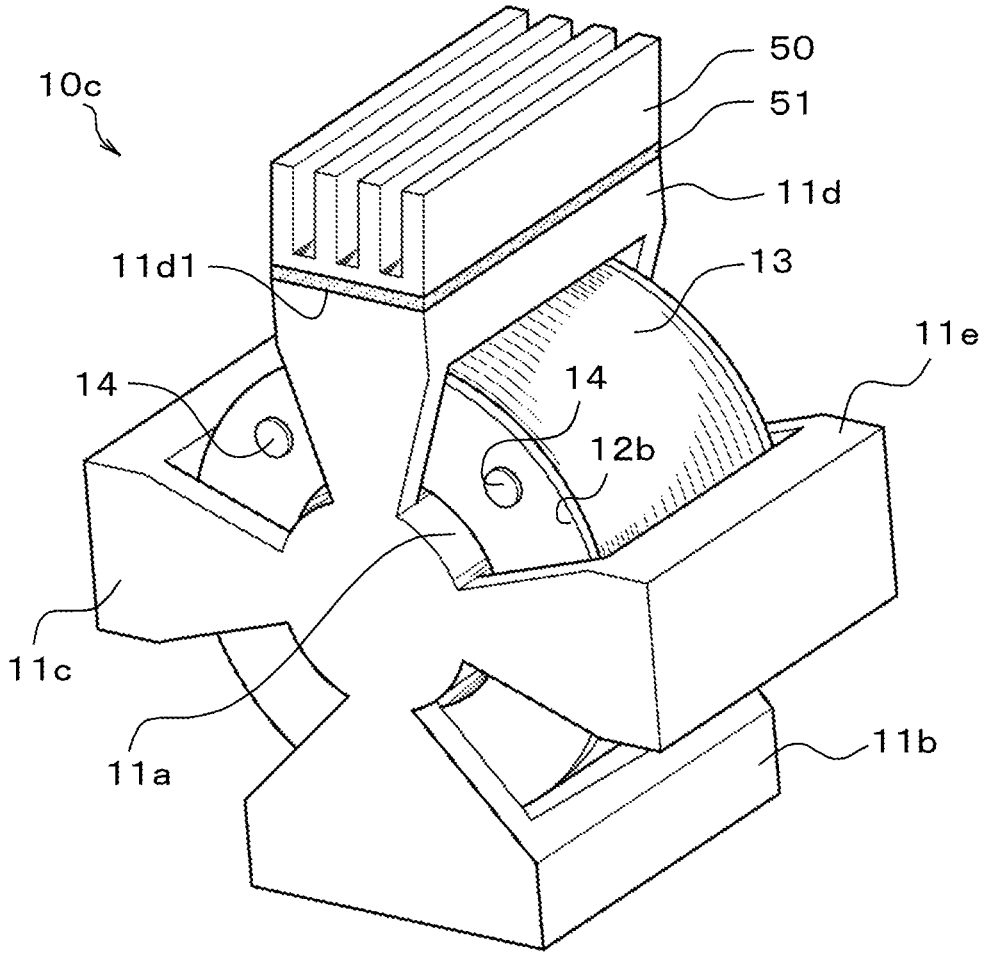
FIG. 9 is a perspective view illustrating an example of a schematic structure of a transformer according to a fourth embodiment of the present invention.

Furthermore, in FIG. 8 and FIG. 9, it is illustrated that the primary coil terminal 14 and the secondary coil terminal 15 are respectively disposed in the flange portions 12*b* of the bobbin 12, which are opposite to each other, a set of terminals disposed in each of the flange portions 12*b* is not limited to such a combination. For example, a first terminal of the primary coil terminal 14 and a first terminal of the secondary coil terminal 15 may be disposed in the same flange portion 12*b*, and a second terminal of the primary coil terminal 14 and a second terminal of the secondary coil terminal 15 may be disposed in the flange portion 12*b* on a side opposite to the flange portion 12*b* described above.

However, for example, as illustrated in FIG. 5, in a case where the transformer 10 is vertically disposed, the primary coil terminal 14 and the secondary coil terminal 15 are disposed only in the same flange portion 12*b* of the bobbin 12 on an upper surface side. In contrast, in this embodiment, the transformer 10*b* is horizontally disposed, and thus, the primary coil terminal 14 and the secondary coil terminal 15 are capable of being respectively disposed in the flange portions 12*b* of the bobbin 12, which are different from each other. This indicates that the freedom degree of a terminal setting position increases, and becomes advantageous characteristics when the size of the transformer 10*b* is reduced.

In general, in a case where the size of the transformer 10*b* is reduced, a distance between each of the primary coil terminal 14 and the secondary coil terminal 15 shortens, and thus, a problem occurs in which it is difficult to ensure an insulating distance. However, in this embodiment, the primary coil terminal 14 and the secondary coil terminal 15 are capable of being disposed in the flange portions 12*b* which are opposite to each other, and thus, the insulating distance between each of the terminals is easily ensured. That is, in this embodiment, an effect is obtained in which it is possible to not only simply reduce the size of the transformer but also easily realize a small-size and large-capacitance transformer.

(Fourth Embodiment)

FIG. 9 is a perspective view illustrating an example of a schematic structure of a transformer 10*c* according to a fourth embodiment of the present invention. The transformer 10*c* according to the fourth embodiment has the has approximately the same structure as that of the transformer 10*b* (refer to FIG. 7) according to the third embodiment described above, but is different from the transformer 10*b* of the other embodiment in that a heat radiation fin 50 is mounted on an upper portion of the core leg portion 11*d*.

As illustrated in FIG. 9, a flat lower surface of the heat radiation fin 50 adheres to the outer circumferential surface 11*d*1 of the core leg portion 11*d* through a high thermal conducting material 51. Here, an adhesive agent in which a ceramic powder such as aluminum nitride and alumina, a metal powder not having magnetic properties, such as aluminum and copper, carbon, and the like are contained, can be used as the high thermal conducting material 51. Alternatively, a filler in which the same ceramic powder, metal powder, carbon, and the like are contained in silicone oil, may be used as the high thermal conducting material 51. Here, in this case, the heat radiation fin 50 is required to be fixed to the core leg portion 11*d* by using a bolt or the like (not illustrated). Alternatively, a structure is required in which the heat radiation fin 50, the transformer 10*c* including the core leg portion 11*d*, and the housing 20 in which the transformer 10*c* is mounted are fixed together, similarly by using the bolt or the like.

In addition, copper, aluminum, or the like, having a high thermal conductivity, is used as the material of the heat radiation fin 50. Then, the heat radiation fin 50 is disposed on the core leg portion 11*d* such that the direction of a groove formed on an upper portion of the heat radiation fin 50 is identical to the direction of the central axis 11*a*1 of the core center portion 11*a* (refer to FIG. 1). Further, as illustrated in FIG. 3 and FIG. 4, the transformer 10*c* is disposed in the housing 20 such that the direction of the cold air 106 of the fan 102 is identical to the direction of the central axis 11*a*1 of the core center portion 11*a*. Thus, it is possible to more effectively increase a heat radiation amount from the heat radiation fin 50.

As described above, according to this embodiment, it is possible to increase a heat radiation amount from the core 11 by the heat radiation fin 50, and thus, it is possible to more effectively suppress an increase in the temperature in the core center portion 11*a*, and to prevent the heating. Accordingly, it is possible to further reduce the diameter of the columnar core center portion 11*a*, and thus, the size of the transformer 10*c* is reduced.

Furthermore, in this embodiment, the heat radiation fin 50 is attached to the core leg portion 11*d* which is positioned in an upper portion of the core 11, and may be attached to one of the core leg portions 11*c* and 11*e* positioned in a side portion of the core 11, or may be attached to two or all three of the core leg portions 11*c*, 11*d*, and 11*e*.

The present invention is not limited to the embodiments and the modification examples described above, and includes various modification examples. For example, the embodiments and the modification examples described above have been described in detail such that the present invention is easily understood, and the present invention is not limited to necessarily having all of the configurations described above. In addition, a part of the configuration of a certain embodiment or modification example can be substituted with the configuration of the other embodiment or modification example, and the configuration of the other embodiment or modification example can be added to the configuration of a certain embodiment or modification example. In addition, the addition, the deletion, and the substitution of the configurations of other embodiments or modification examples can be performed with respect to a part of the configurations of each of the embodiments or the modification examples.

REFERENCE SIGNS LIST

10, 10*a*, 10*b*, 10*c* transformer
11 core
11*a* core center portion
11*a*1 central axis
11*b*, 11*c*, 11*d*, 11*e* core leg portion
11*b*1, 11*c*1, 11*d*1, 11*e*1 outer circumferential surface
12 bobbin
12*a* cylindrical portion
12*b* flange portion
13 coil
14 primary coil terminal
15 secondary coil terminal
20 housing (storage mirror body)
20*a* floor surface
21 high thermal conducting material
30 high thermal conducting resin
50 heat radiation fin
51 high thermal conducting material
100, 100*a* power converter
101 input and output terminal
102 fan
103 power conversion circuit
104 control circuit
105 power source circuit
106 cold air

The invention claimed is:

1. A transformer comprising:

a coil configured by winding a conductive wire into a shape of a spiral cylinder;

a core center portion having a columnar shape in which the coil is mounted; and a plurality of core leg portions joining both ends of the core center portion on the outside of the coil, wherein the transformer is disposed in a storage housing in a state in which a central axis of the core center portion is approximately parallel to a floor surface of the storage housing on which the transformer is mounted, wherein the transformer is disposed in the storage housing such that one core leg portion of the plurality of core leg portions includes a flat outer circumferential surface approximately parallel to a tangential plane which is tangent to an outer circumferential side surface of the coil having a spiral cylindrical shape, and the outer circumferential surface of the one core leg portion is tangent to the floor surface of the storage housing, and the outer circumferential surface of the one core leg portion adheres to the floor surface of the storage housing through a high thermal conducting material.

2. The transformer according to claim 1, wherein a size of the one core leg portion is larger than a size of the core leg portion of the plurality of core leg portions, which is different from the one core leg portion.

3. The transformer according to claim 1, wherein at least one core leg portion of the plurality of core leg portions, which is different from the one core leg portion, includes a flat outer circumferential surface approximately parallel to a tangential plane which is tangent to an outer circumferential side surface of the coil having a spiral cylindrical shape, and a heat radiation fin is disposed on the outer circumferential surface.

4. The transformer according to claim 1, wherein a high thermal conducting material is interposed between an inner wall of the coil having a spiral cylindrical shape and an outer wall of the core center portion in which the coil is mounted.

5. The transformer according to claim 1, wherein of four terminals which are respectively connected to a primary coil and a secondary coil configuring the coil, two terminals are disposed on one end surface side of the coil, and two other two terminals are disposed on an other end surface side of the coil.

6. A power converter comprising:

a transformer including a coil configured by winding a conductive wire into a shape of a spiral cylinder, a core center portion having a columnar shape in which the coil is mounted, and a plurality of core leg portions joining both ends of the core center portion on the outside of the coil;

a storage housing in which the transformer is mounted on a floor surface; and a fan which is disposed on a side surface portion of the storage housing and blows cold air to the transformer, wherein the transformer is disposed in the storage housing such that a central axis of the core center portion is approximately parallel to the floor surface of the storage housing on which the transformer is mounted and a direction of the central axis of the core center portion is identical to a direction of the cold air blown from the fan, wherein the transformer is disposed in the storage housing such that one core leg portion of the plurality of core leg portions includes a flat outer circumferential surface approximately parallel to a tangential plane which is tangent to an outer circumferential side surface of the coil having a spiral cylindrical shape, and the outer circumferential surface of the one core leg portion is tangent to the floor surface of the storage housing, and wherein the outer circumferential surface of the one core leg portion adheres to the floor surface of storage housing through a high thermal conducting material.

7. The power converter according to claim 6, wherein a size of the one core leg portion is larger than a size of the core leg portion of the plurality of core leg portions, which is different from the one core leg portion.

8. The power converter according to claim 6, wherein at least one core leg portion of the plurality of core leg portions, which is different from the one core leg portion, includes a flat outer circumferential surface approximately parallel to a tangential plane which is tangent to an outer circumferential side surface of the coil having a spiral cylindrical shape, and a heat radiation fin is disposed on the outer circumferential surface.

9. The power converter according to claim 6, wherein a high thermal conducting material is interposed between an inner wall of the coil having a spiral cylindrical shape of the transformer and an outer wall of the core center portion in which the coil is mounted.

10. The power converter according to claim 6, wherein of four terminals which are respectively connected to a primary coil and a secondary coil configuring the coil of the transformer, two terminals are disposed on one end surface side of the coil, and two other two terminals are disposed on an other end surface side of the coil.

* * * * *